US005351896A

United States Patent [19]

Nuttall

[11] Patent Number: 5,351,896

[45] Date of Patent: Oct. 4, 1994

[54] FLUORESCENT TUBE BREAKING APPARATUS

[76] Inventor: Jimmy P. Nuttall, 2775 Locust, Montrose, Colo. 81401

[21] Appl. No.: 130,691

[22] Filed: Oct. 4, 1993

[51] Int. Cl.[5] ..... B02C 19/12; B02C 1/00

[52] U.S. Cl. ..... 241/99; 241/283

[58] Field of Search ..... 241/99, 283; 285/303

[56] References Cited

U.S. PATENT DOCUMENTS

| | | | |
|---|---|---|---|
| 2,137,191 | 11/1938 | Legg | 241/99 |
| 2,230,019 | 1/1941 | Tucke | 241/99 |
| 3,828,976 | 8/1974 | Sidelinker | 241/99 |
| 4,662,535 | 5/1987 | Loveland | 241/99 |
| 4,771,952 | 9/1988 | Speier | 241/99 |

FOREIGN PATENT DOCUMENTS

| | | | |
|---|---|---|---|
| 1121346 | 8/1956 | France | 285/303 |

*Primary Examiner*—Richard K. Seidel
*Assistant Examiner*—Paul Heyrana
*Attorney, Agent, or Firm*—E. Michael Combs

[57] ABSTRACT

A housing organization arranged to complementarily accommodate a fluorescent tube permitting its breakage is provided, wherein the housing includes a guide tube having an impact rod directed through the guide tube for communication with the housing to effect destruction of the fluorescent tube permitting ease of its disposal.

1 Claim, 4 Drawing Sheets

FLUORESCENT TUBE BREAKING APPARATUS

BACKGROUND OF THE INVENTION

1. Field of the Invention

The field of invention relates to comminuting apparatus, and more particularly pertains to a new and improved fluorescent tube breaking apparatus wherein the same is directed to the breaking of a fluorescent tube and its containment for subsequent disposal.

2. Description of the Prior Art

Fluorescent tubes due to their frangible nature and the hazards associated due to inadvertent breakage are well known, such that inadvertent breakage of fluorescent tube, the glass due to its relative thinness and sharpness creates many safety hazards. The instant invention attempts to provide for advantages over the prior art to permit the containment of a fluorescent tube during its breakage permitting its ease of disposal within an associated safety container and in this respect, the present invention substantially fulfills this need.

SUMMARY OF THE INVENTION

In view of the foregoing disadvantages inherent in the known types of comminuting apparatus now present in the prior art, the present invention provides a fluorescent tube breaking apparatus wherein the same is arranged to receive a fluorescent tube providing for its storage prior to and during impact. As such, the general purpose of the present invention, which will be described subsequently in greater detail, is to provide a new and improved fluorescent tube breaking tube apparatus which has all the advantages of the prior art fluorescent tube removal apparatus and none of the disadvantages.

To attain this, the present invention provides a housing organization arranged to complementarily accommodate a fluorescent tube permitting its breakage, wherein the housing includes a guide tube having an impact rod directed through the guide tube for communication with the housing to effect destruction of the fluroescent tube permitting ease of its disposal.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluorescent tube breaking apparatus which has all the advantages of the prior art fluorescent tube removal apparatus and none of the disadvantages.

It is another object of the present invention to provide a new and improved fluorescent tube breaking apparatus which may be easily and efficiently manufactured and marketed.

It is a further object of the present invention to provide a new and improved fluorescent tube breaking apparatus which is of a durable and reliable construction.

An even further object of the present invention is to provide a new and improved fluorescent tube breaking apparatus which is susceptible of a low cost of manufacture with regard to both materials and labor, and which accordingly is then susceptible of low prices of sale to the consuming public, thereby making such fluorescent tube breaking apparatus economically available to the buying public.

Still yet another object of the present invention is to provide a new and improved fluorescent tube breaking apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
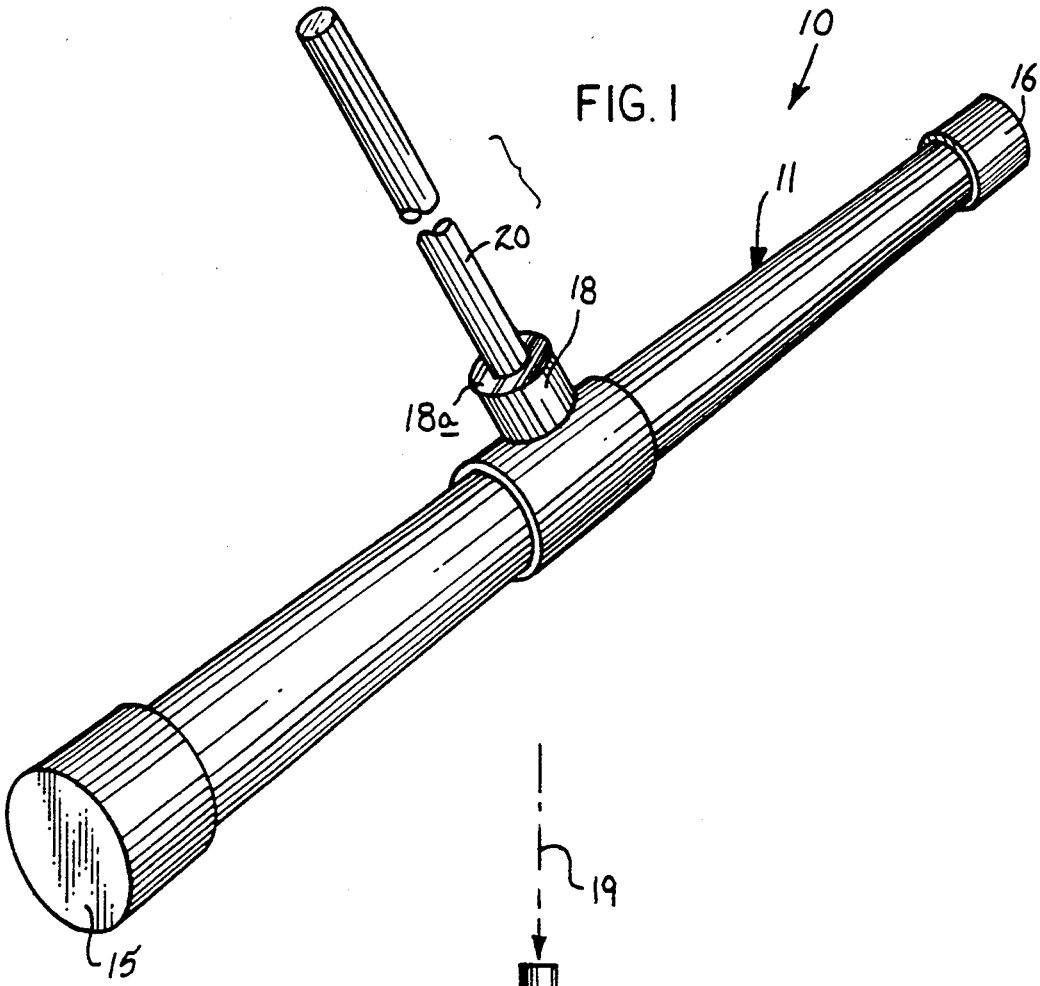
FIG. 1 is an isometric illustration of the invention.
Figure 2:
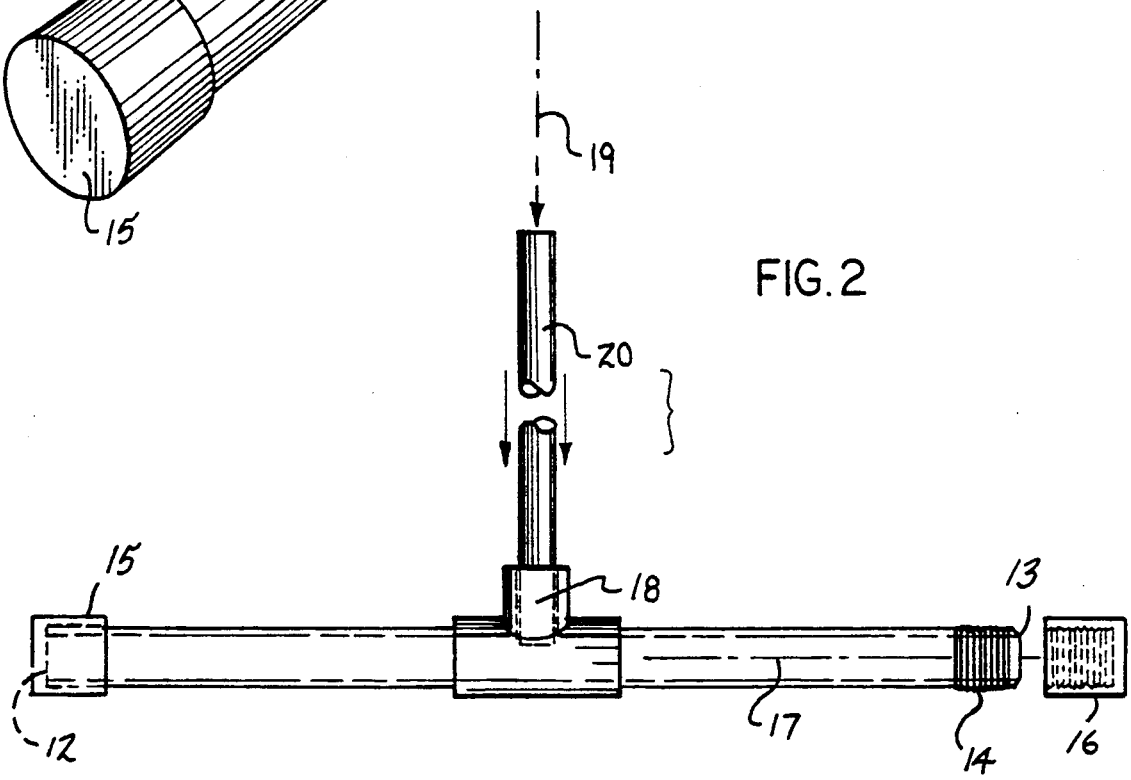
FIG. 2 is an orthographic side view of the invention.

With reference now to the drawings, and in particular to FIGS. 1 to 6 thereof, a new and improved fluorescent tube breaking apparatus embodying the principles and concepts of the present invention and generally designated by the reference numerals 10, 10*a*, and 10*b* will be described.

Figure 3:
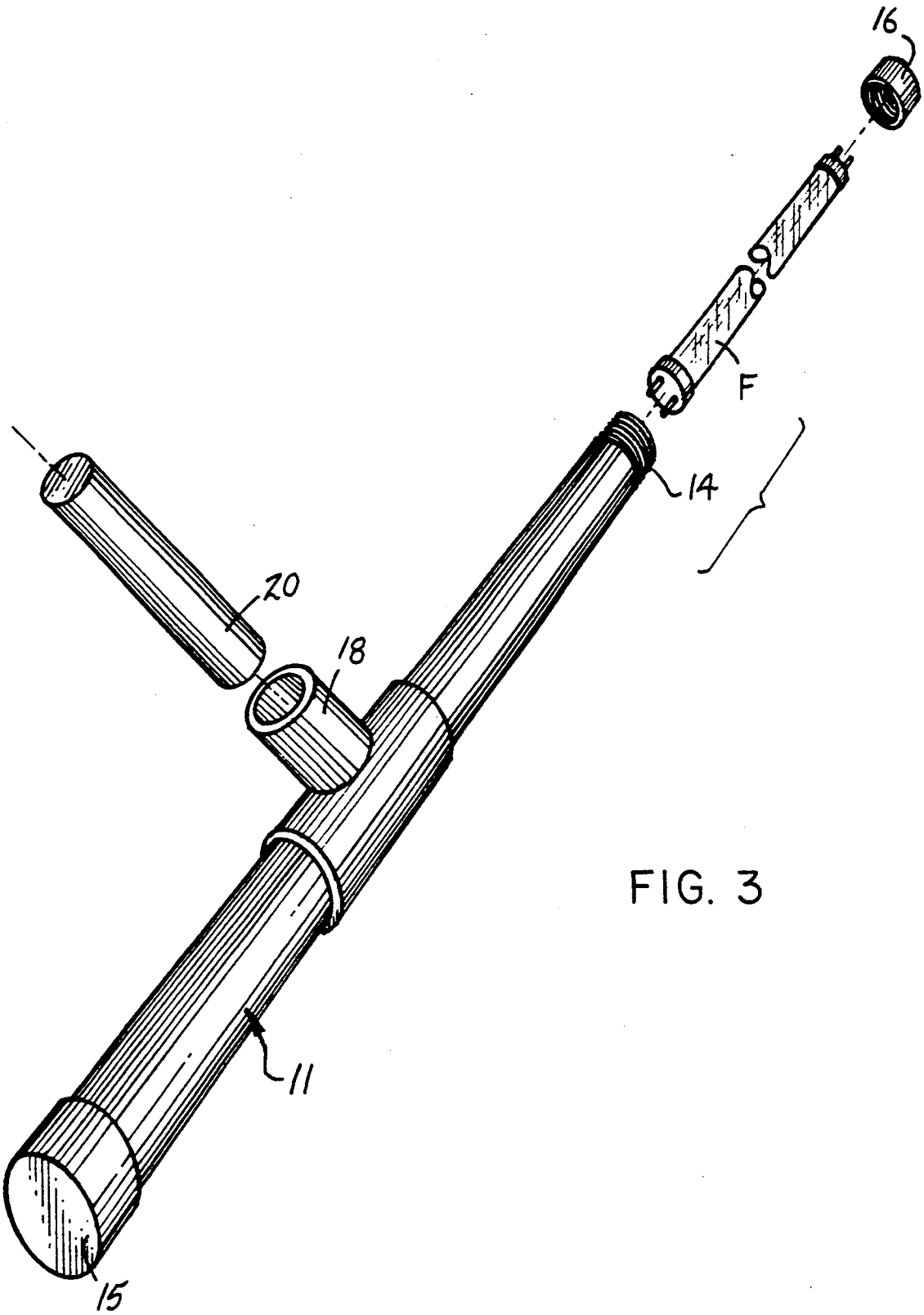
FIG. 3 is an isometric illustration of the invention indicating reception of a fluorescent tube therewithin.

More specifically, the fluorescent tube breaking apparatus 10 of the instant invention essentially comprises an elongate rigid tubular housing 11 symmetrically oriented about a housing axis, such that the housing includes a housing first end 12 spaced from a housing second end 13. The housing second end 13 includes a threaded portion 14 directed about the housing side wall extending to the second end 13 for securement of a second end cap 16 that is internally threaded for securement to the threaded portion 14. A first end cap 15 is fixedly secured to the housing first end 12 but may optionally be separably mounted in use of threads, as well as other mechanical fastening structure. A guide tube 18 is fixedly mounted to the housing side wall extending in communication with the cavity of the housing 11, such that the guide tube axis 19 intersects the housing axis 17. The guide tube includes a roof plate 18*a* to slidably guide a rigid impact 20 along the tube axis 19 to effect destruction and breakage of a fluorescent tube "F" received within the housing 11, in a manner as indicated in FIG. 3.

Figure 4:
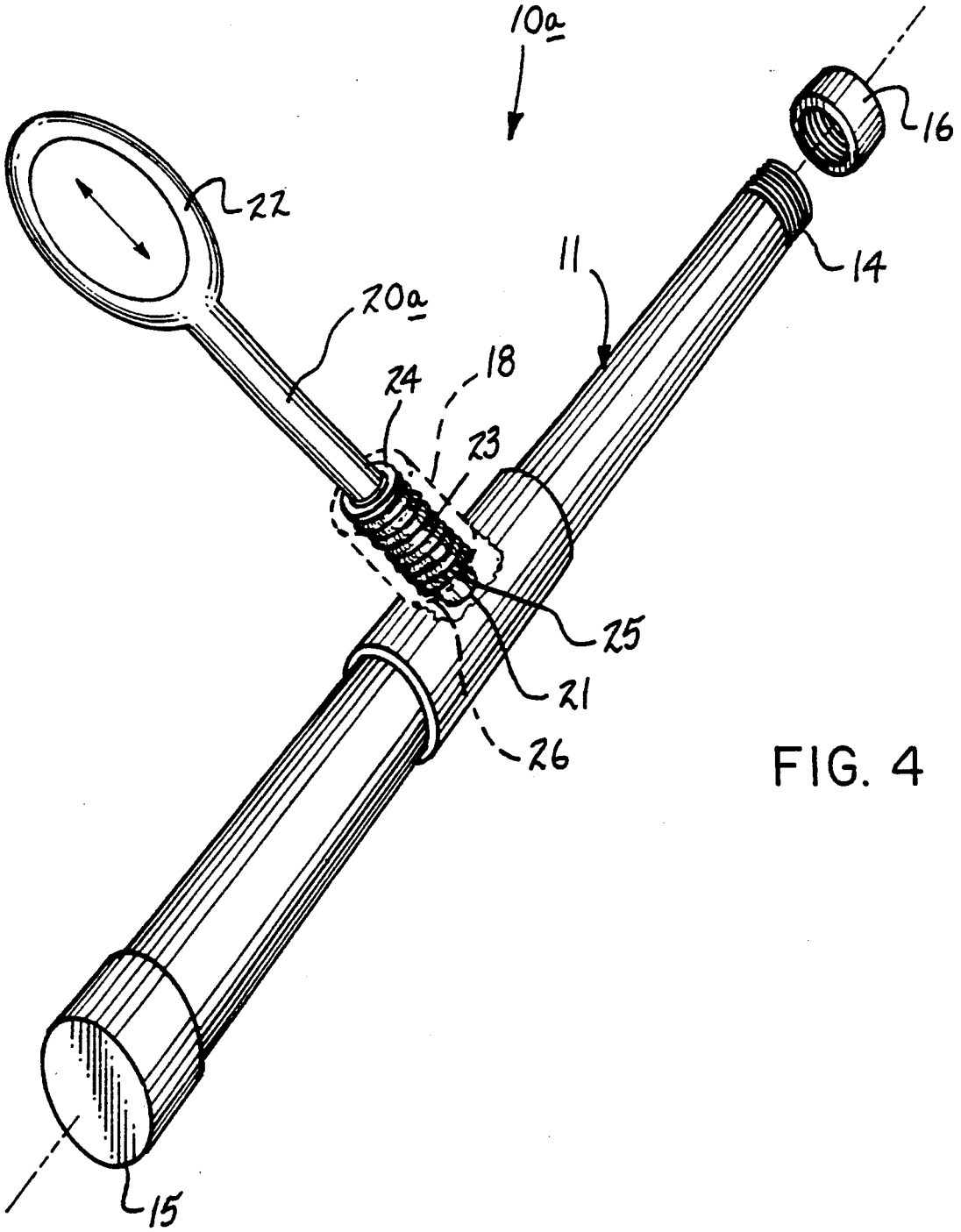
FIG. 4 is an isometric illustration of a modified aspect of the invention.

The FIG. 4 indicates an apparatus 10*a*, wherein the guide tube 18 includes a spring 23 contained within the guide tube 18, with the spring having a first end cap 24 in contiguous communication with the guide tube roof plate 18*a*, with a spring second end 25 mounted upon the guide tube floor 26 to thereby capture the spring within the guide tube 18. The spring first end cap 24 is fixedly secured to a modified impact rod 20*a*, and wherein the spring 23 biases the first end cap 24 towards the guide tube floor 26 such that upon lifting of the impact rod 20*a* by a handle 22 mounted to the impact rod second end effects projection of the impact rod first end 21 onto the fluorescent tube "F" upon release of the handle 22.

Figures 5, 6:
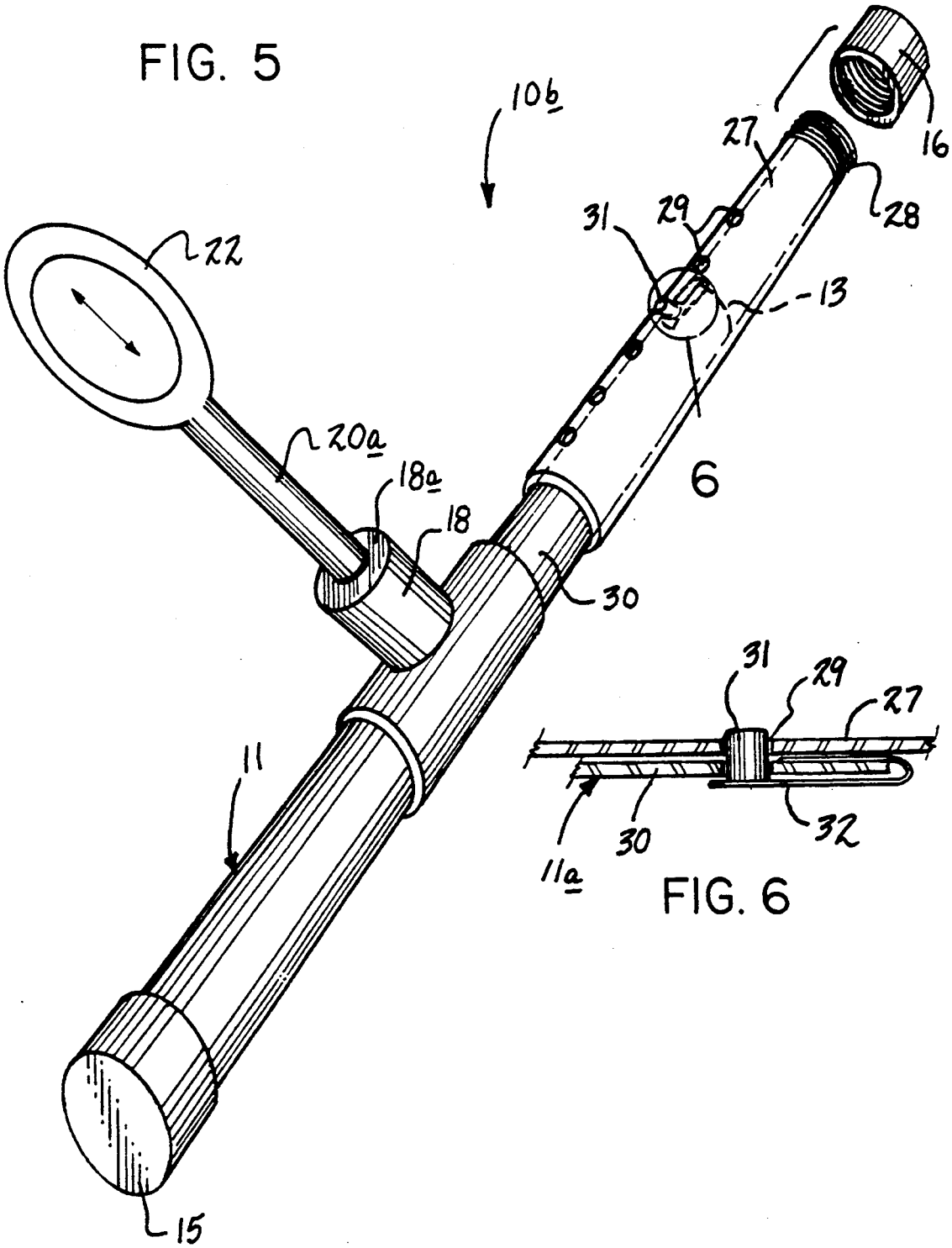
FIG. 5 is a further modified aspect of the invention.
FIG. 6 is an orthographic cross-sectional illustration of section 6 as set forth in FIG. 5.

A housing sleeve 27 is provided, as illustrated in FIG. 5, in cooperation with the apparatus 10*b* that is constructed in a manner as indicated in relative to the apparatus 10*a* of FIG. 4, but to include a housing sleeve 27 slidably directed along the housing side wall 30 between the guide tube 18 and projecting beyond the housing second end 13. The housing sleeve 27 terminates in a sleeve externally threaded outer distal end 28, with a row of openings 29 oriented parallel to the axis 17 directed through the sleeve for cooperation with a lock button 31 mounted within the housing side wall 30. The lock button 31 is received within one of the openings 29, with the lock button having a lock button spring 32 mounted to the lock button and to the housing side wall to project the lock button 31 through one of the openings 29, in a manner as indicated in FIG. 5, to accommodate fluorescent tubes of various lengths.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A fluorescent tube breaking apparatus, comprising, an elongate rigid tubular housing, having a housing first end spaced from a housing second end, the housing having a housing side wall, with the housing symmetrically oriented about a housing axis, a housing threaded portion extends about the housing side wall extending from the housing second end and the housing threaded portion spaced from the housing first end, with a first end cap secured to the housing first end, and a second end cap having an internally threaded skirt arranged for securement to the housing threaded portion, and a guide tube fixedly mounted to the housing between the housing first end and the housing second end, with the guide tube having a guide tube cavity, the housing having a housing cavity, the guide tube cavity in communication with the housing cavity, and a rigid impact rod slidably received through the guide tube and received within the housing cavity from the guide tube, and the rigid impact rod includes an impact rod first end and an impact rod second end, the impact rod first end is arranged for reception within the housing cavity, the impact rod second end having a second end handle, and the impact rod including an impact rod cap fixedly mounted to the impact rod, and a spring member mounted to the cap and the guide tube having a guide tube floor, with the spring member captured between the guide tube floor and the cap, with the spring biased towards the guide tube floor to bias the impact rod first end within the housing cavity, and the guide tube having a guide tube roof plate to orient the spring between the guide tube roof plate and the guide tube floor to guidably direct the impact rod through the guide tube, and a housing sleeve, the housing sleeve slidably received over the housing side wall and projecting beyond the housing second end, with the sleeve having a sleeve outer distal end, and the sleeve outer distal end including a sleeve threaded portion arranged to receive said second end cap, the sleeve including a row of openings parallel to the housing axis directed through the sleeve, with the housing side wall including a lock button projecting through the side wall, with the lock button including a lock button spring mounted to the housing side wall and to the lock button to project the lock button through the housing side wall and through one of said openings.

* * * * *